US007810211B2

(12) United States Patent
Chong et al.

(10) Patent No.: US 7,810,211 B2
(45) Date of Patent: Oct. 12, 2010

(54) VACUUM CLEANER HAVING AGITATOR PERFORMING LINEAR TRANSLATION

(75) Inventors: Chung-ook Chong, Daegu (KR); Keyong-seon Jeong, Changwon-shi (KR); Kie-tak Hyun, Gimhae-shi (KR); Seong-koo Cho, Busan (KR); Geun-bae Hwang, Changwon-shi (KR); Kyu-chun Choi, Ulsan (KR); Jin-hyouk Shin, Busan (KR); Jong-kyu Jang, Suncheon-shi (KR)

(73) Assignee: LG Electronics Inc., Seoul (KR)

( * ) Notice: Subject to any disclaimer, the term of this patent is extended or adjusted under 35 U.S.C. 154(b) by 158 days.

(21) Appl. No.: 11/826,692

(22) Filed: Jul. 17, 2007

(65) Prior Publication Data

US 2008/0028571 A1 Feb. 7, 2008

(30) Foreign Application Priority Data

Jul. 19, 2006 (KR) ..... 10-2006-0067644

(51) Int. Cl.
*A47L 9/04* (2006.01)

(52) U.S. Cl. ..... 15/381; 15/380; 15/363

(58) Field of Classification Search ..... 15/380, 15/363, 412, 415.1, 381, 382
See application file for complete search history.

(56) References Cited

U.S. PATENT DOCUMENTS 1,940,954 A * 12/1933 Kohler ..... 15/364
4,069,541 A * 1/1978 Williams et al. ..... 15/321
5,901,411 A * 5/1999 Hato et al. ..... 15/381
6,539,575 B1 4/2003 Cohen

FOREIGN PATENT DOCUMENTS

| | | |
|---|---|---|
| CN | 1163740 | 11/1997 |
| EP | 0786228 | 7/1997 |
| JP | 2002-078651 | 3/2002 |
| JP | 2003-276332 | 9/2003 |
| KR | 20-0399761 | 10/2005 |
| KR | 10-2006-0008729 | 1/2006 |
| WO | WO 01/01819 | 11/2001 |

OTHER PUBLICATIONS

Chinese Office Action dated Feb. 6, 2009.
European Search Report dated Nov. 19, 2007.

* cited by examiner

*Primary Examiner*—Dung Van Nguyen
(74) *Attorney, Agent, or Firm*—Ked & Associates, LLP

(57) ABSTRACT

A vacuum cleaner is provided that includes a vacuum cleaner main body having a suction pump, a suction nozzle portion that sucks impurities by a suction force supplied by the suction pump, a suction passage that connects the suction nozzle portion to the suction pump, an agitator installed at the suction passage, and a driving device that makes the agitator perform a linear translation. As the agitator is formed narrow and long, a bottom surface of the suction nozzle portion may maintain a small suction area. Therefore the vacuum cleaner attains a high surface pressure which is an advantage of an ordinary type suction nozzle portion, and a high drag coefficient of impurities which is an advantage of a brush type suction nozzle portion.

12 Claims, 10 Drawing Sheets

VACUUM CLEANER HAVING AGITATOR PERFORMING LINEAR TRANSLATION

TECHNICAL FIELD

The present invention relates to a vacuum cleaner, and more particularly, to a vacuum cleaner having an agitator performing linear translation at its suction nozzle portion.

BACKGROUND ART

A vacuum cleaner sucks the air containing impurities by a vacuum pressure generated by a vacuum motor installed in a main body, filters off the impurities in the main body, and collects and discharges the impurities.

The vacuum cleaner sucks the air containing the impurities through a suction nozzle portion. The position of the suction nozzle portion must be continuously changed to clean a large area space. The cleaning performance of the vacuum cleaner is lower on a carpet than a floor. That is, the vacuum cleaner cannot efficiently suck the impurities due to an adhesion force between carpet hairs and impurity particles.

Accordingly, a brush is installed at the suction nozzle portion of the vacuum cleaner, for lifting the impurity particles from the carpet hairs. As the suction nozzle portion having the brush separates the impurity particles from the carpet hairs by using the brush and sucks the impurities, it is advantageous in a drag coefficient. However, in the case of a power nozzle portion or a turbine type nozzle portion into which a brush is inserted, a suction passage is enlarged due to a large diameter of the brush. The power nozzle portion or the turbine type nozzle portion has a lower surface pressure than an ordinary type nozzle portion, and thus is disadvantageous in the aspect of the surface pressure generation.

FIGS. 1 and 2 illustrate a top surface and a bottom surface of a conventional ordinary type nozzle portion. Referring to FIG. 2, a vacuum channel 1 and a suction hole 2 are formed at the bottom surface of the suction nozzle portion. The suction hole 2 is positioned in a suction passage connecting a suction pump to the suction nozzle portion, and the vacuum channel 1 is extended from the suction hole 2 in the right-left direction, for defining part of the suction passage. Impurities of the surface contacting the vacuum channel 1 are moved with the air along the vacuum channel 1, and collected in a collection box in a main body of a vacuum cleaner through the suction hole 2. The vacuum channel 1, which is formed narrow and long, has a high surface pressure, and advantageously sucks the impurities from the floor. However, in the case of a carpet to which impurities stick, a sum of an adhesion force A and an impurity weight G is larger than a lifting force F. It is thus impossible to efficiently suck the impurities.

FIGS. 3 and 4 illustrate a top surface of a conventional brush type nozzle portion in which a brush 3 is installed. The brush 3 is rotated to separate impurities from a carpet. When a lifting force F is larger than a gravity G operated on the impurities, the impurities can be sucked. However, the brush 3 increases the whole size of the suction nozzle portion. Moreover, the brush 3 is rotated around a rotation shaft, to clean only a region which brush bristles rotation-contact. A region between the brush bristles is relatively poorly cleaned. Meanwhile, in order to rotate the brush 3, a motor is connected to the rotation shaft of the brush 3 through a transmission belt, for transferring a driving force to the rotation shaft of the brush 3. If the transmission belt is used for a long time, it is broken, and thus replaced. As a result, reliability of the product is reduced.

DISCLOSURE OF THE INVENTION

An object of the present invention is to provide a vacuum cleaner which can maintain a high surface pressure which is an advantage of an ordinary type nozzle portion, and increase a drag coefficient of impurities.

In order to achieve the above-described object of the invention, there is provided a vacuum cleaner, including: a vacuum cleaner main body for supplying a suction force; a suction nozzle portion for sucking impurities by the suction force; a suction passage for connecting the suction nozzle portion to a suction pump; and an agitator installed at the suction passage, for performing linear translation. In this configuration, as the agitator is formed narrow and long, the bottom surface of the suction nozzle portion can maintain a small suction area. Therefore, the vacuum cleaner attains a high surface pressure which is an advantage of an ordinary type suction nozzle portion, and a high drag coefficient of impurities which is an advantage of a brush type suction nozzle portion.

The suction nozzle portion includes, at its bottom surface, a vacuum channel connected to the suction passage, for defining part of the suction passage.

The agitator is installed in at least one of the forward and backward directions of the vacuum channel. In this configuration, the vacuum cleaner can easily suck the impurities shaken off from a carpet by the agitator.

The suction nozzle portion further includes an agitator guide at its bottom surface, and the length of the agitator is smaller than the length of the suction nozzle portion and the length of the agitator guide. In this configuration, the agitator can stably perform the linear translation.

The guide is a groove for receiving the agitator. For example, the guide is a deeper groove than the vacuum channel provided as a groove at the bottom surface of the suction nozzle portion, and the agitator is received in the groove.

The guide includes protrusion portions protruding from the front and rear portions of the agitator. For example, the guide may include one protrusion portion longer than the agitator at each of the front and rear portions of the agitator, or a plurality of protrusion portions shorter than the agitator at each of the front and rear portions of the agitator.

The guide and the agitator include a rail member. In this configuration, the agitator can more stably softly perform the linear translation along the rail member.

The rail member includes a rail and a rail groove. For example, the guide may include a rail and the agitator may include a rail groove corresponding to the rail, or the agitator may include a rail and the guide may include a rail groove corresponding to the rail.

The agitator includes a plurality of protruding blades. The plurality of blades are provided in the longitudinal direction of the agitator. Accordingly, when the agitator performs the linear translation, the blades also perform the linear translation, to completely clean the region which the suction nozzle portion passes.

The blade includes a brush at its protruding end. In this configuration, as the diameter of one brush bristle is smaller than that of the blade, gaps between carpet hairs can be carefully cleaned.

The blade is diagonally inclined to the translation direction of the agitator. In this configuration, the impurities shaken off from the carpet by the translation of the blade can be easily sucked along the suction passage.

The vacuum cleaner further includes a driving unit for driving the agitator.

The driving unit includes a slider-crank and a motor. The rotation of the motor is converted into the translation and transferred to the agitator by the slider-crank.

The driving unit includes a tangent cam, a motor, and a spring installed between the agitator and the suction nozzle portion. The rotation of the motor is converted into the linear motion and transferred to the agitator by the tangent cam and the spring.

The driving unit includes a cylindrical cam and a motor.

Referring to FIG. 5, the basic mechanism of the vacuum cleaning is to suck particles by using a lifting force F.

$$F = C_D \frac{\pi}{8} \rho d_p^2 V^2$$

F: Lifting force $C_D$: Drag coefficient

ρ: Density $d_p$: Particle diameter

V: Velocity

Here, the lifting force is proportional to the square of the drag coefficient and the velocity.

$$\Delta P \propto \rho V^2$$

As the surface pressure is proportional to the square of the velocity, the lifting force is deemed to be proportional to the surface pressure. Therefore, the drag coefficient and the surface pressure (dynamic pressure) must be increased together so as to improve the cleaning performance.

When there are few factors interrupting the movement of the impurities as on the floor, the drag coefficient is large, and when there are many factors interrupting lifting of the impurities like the carpet hairs, the drag coefficient is small. On the floor, when the lifting force F is larger than the impurity weight G, the impurities can be sucked. Meanwhile, as explained in FIG. 1, on the carpet, an adhesion force A such as a static electric force exists between the carpet hairs and the impurities. Accordingly, when the lifting force F is larger than the sum of the impurity weight G and the adhesion force A, the impurities can be sucked.

Exemplary suction nozzle portions of the vacuum cleaner include an ordinary type suction nozzle portion designed so that a passage of a suction end can increase a surface pressure, and a brush type suction nozzle portion designed so that a brush can decrease a minimum required lifting force by separating impurity particles from an adhesion surface. The prevent invention maximizes the cleaning performance, by combining generation of a high surface pressure which is the advantage of the ordinary type suction nozzle portion, with agitation of particles which is the advantage of the brush type suction nozzle portion. The suction passage on the floor side is formed similarly to that of the ordinary type suction nozzle portion in order to maximize the surface pressure, and the brush stirring the impurities is replaced by a bar-shaped agitator. The agitator performs linear translation by a driving unit. A plurality of individual blades are formed at the agitator, for separating particles from the floor, particularly, the carpet hairs.

BRIEF DESCRIPTION OF THE DRAWINGS

The present invention will become better understood with reference to the accompanying drawings which are given only by way of illustration and thus are not limitative of the present invention, wherein.

BEST MODE FOR CARRYING OUT THE INVENTION

A vacuum cleaner having an agitator performing linear translation in accordance with the preferred embodiments of the present invention will now be described in detail with reference to the accompanying drawings.

Figure 1:
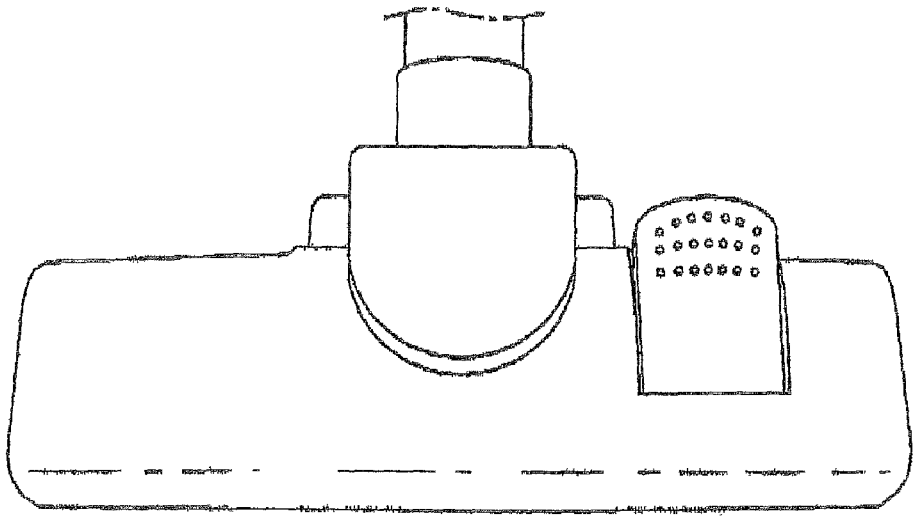
FIG. 1 Prior Art
FIGS. 1 and 2 illustrate one example of a conventional ordinary type suction nozzle portion.
Figure 2:
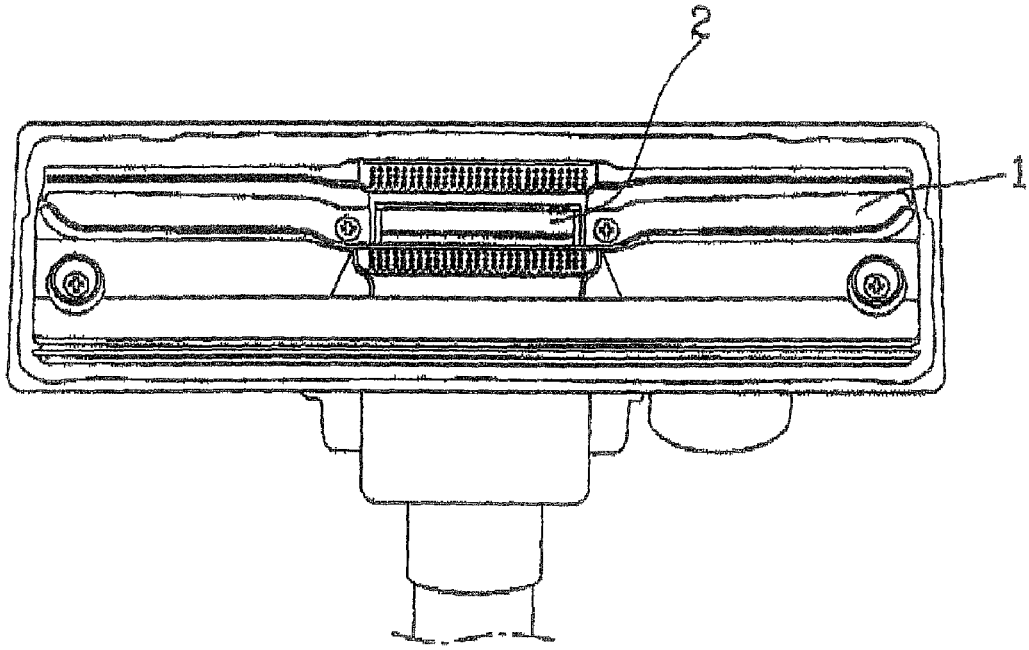
FIG. 2 Prior Art
Figure 3:
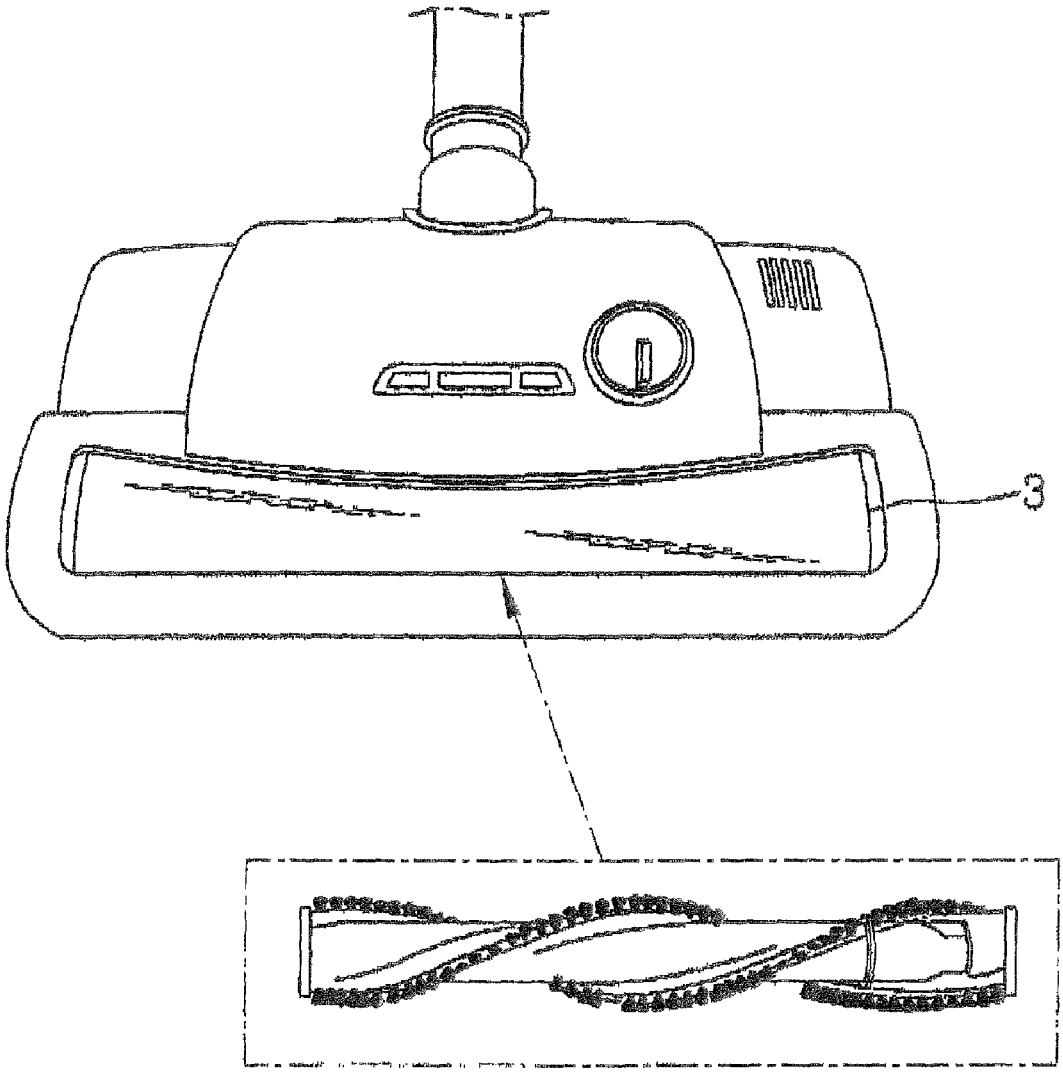
FIG. 3 Prior Art
FIGS. 3 and 4 illustrate one example of a conventional brush type suction nozzle portion.
Figure 4:
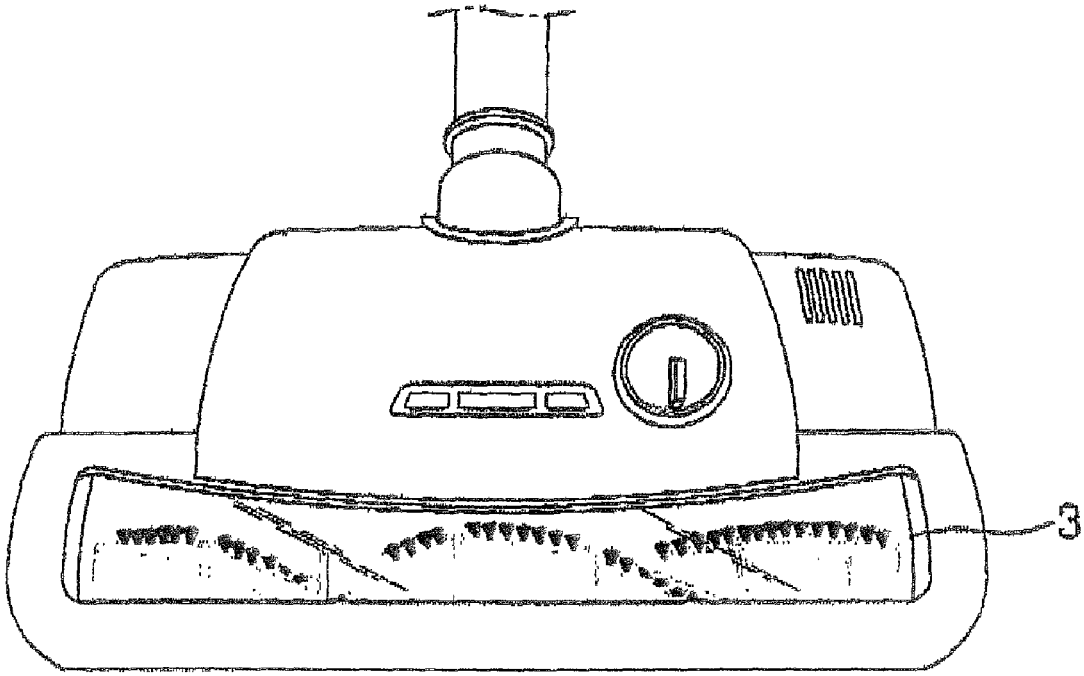
FIG. 4 Prior Art
Figure 5:
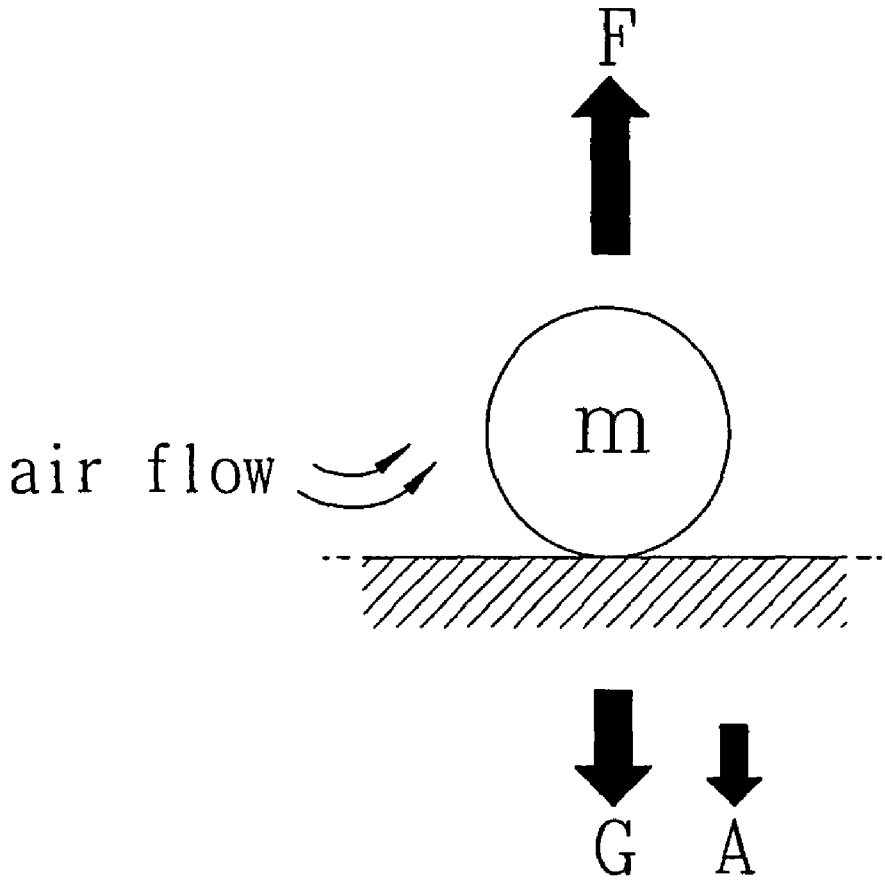
FIG. 5 schematically illustrates a gravity, an adhesion force, a lifting force and an air flow operated on impurities.
Figure 6:
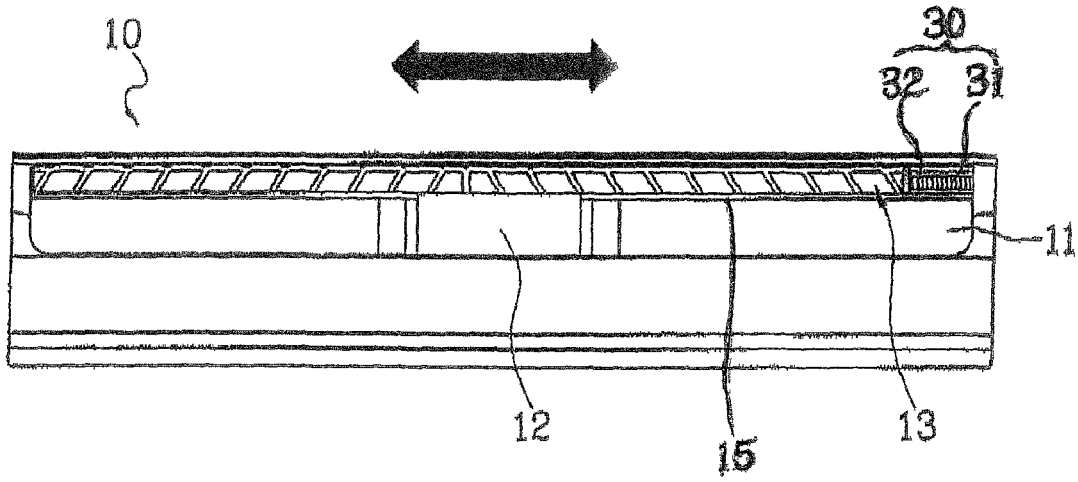
FIG. 6 illustrates a bottom surface of a suction nozzle portion in which an agitator is installed in accordance with the present invention.

FIG. 6 illustrates a bottom surface of a suction nozzle portion in which an agitator is installed in accordance with the present invention. Generally, a vacuum cleaner includes a cleaner main body (not shown) in which a suction pump is installed, and a suction nozzle portion 10 for sucking impurities. The cleaner main body and the suction nozzle portion 10 are connected to each other by a suction passage so that the air can flow therebetween. A suction hole 12 opened to extend the suction passage to the bottom surface of the suction nozzle portion 10 is formed in the bottom surface of the suction nozzle portion 10. A vacuum channel 11 is formed narrow and long at the right and left sides of the suction hole 12 on the bottom surface of the suction nozzle portion 10, for defining part of the suction passage. When the suction pump of the cleaner main body generates a vacuum pressure to be a low pressure, the air is sucked through the suction hole 12 with a relatively high pressure. Therefore, the suction hole 12 has a lower pressure than the vacuum channel 11, so that the air is sucked from the vacuum channel 11 to the suction hole 12. That is, when impurities contact the vacuum channel 11, the impurities are sucked, with the air, from the vacuum channel 11 to the suction pump of the cleaner main body through the suction hole 12 due to a pressure slope. In addition, an agitator 13 performing linear translation is installed at the suction passage of the suction nozzle portion 10. The agitator 13 separates impurities sticking to carpet hairs from a carpet by the linear translation, for easily sucking the impurities. Preferably, the agitator 13 is installed in at least one of the forward and backward directions of the vacuum channel 11. If the agitator 13 is installed in the vacuum channel 11, the agitator 13 blocks most of the suction passage defined at the bottom surface of the suction nozzle portion 10, such as the suction hole 12. In this case, the area of the suction passage which can suck the air and the impurities is seriously narrowed at the bottom surface of the suction nozzle portion 10.

In another aspect of the present invention, the vacuum cleaner further includes an agitator guide 15 for guiding the linear translation of the agitator 13 at the bottom surface of the suction nozzle portion 10. Still referring to FIG. 6, the agitator guide 15 is longer than the agitator 13. That is, a space longer than the agitator 13 is necessary so that the agitator 13 can perform the linear translation. The agitator guide 15 can be any one of protrusion portions 25 protruding from the front and rear portions of the agitator 13, and a groove deeper than the vacuum channel 11.

In addition, the vacuum cleaner further includes a rail member 30 at each of the contact surfaces of the agitator 13 and the agitator guide 15, for guiding the motion of the agitator 13. A convex rail 31 may be formed at the agitator 13, and a groove 32 into which the rail 31 is inserted may be formed at the agitator guide 15. Conversely, a rail may be formed at the agitator guide 15, and a groove into which the rail is inserted may be formed at the agitator 13. As the rail member 30 is provided, the linear translation of the agitator 13 is more stably guided than when it is guided merely by the agitator guide 15.

Figure 7:
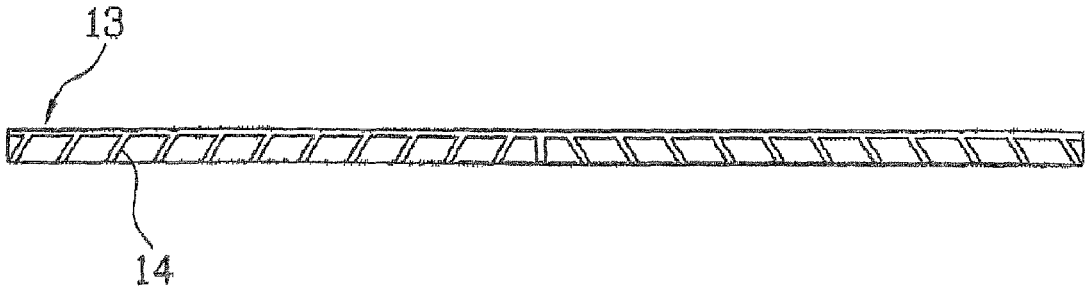
FIGS. 7 and 8 illustrate the structure of the agitator in accordance with the present invention.

FIG. 7 illustrates the agitator in accordance with the present invention. In yet another aspect of the present invention, a plurality of blades 14 perpendicular to the floor to be cleaned are formed at the agitator 13. As the agitator 13 performs the translation, the plurality of blades 14 also perform the translation. The blades 14 shake the carpet hairs by performing the translation between the carpet hairs, thereby separating the impurities sticking to the carpet hairs from the carpet hairs. The impurities are shaken off from the carpet hairs, sucked into the vacuum channel 11, and transferred from the vacuum channel 11 to the cleaner main body through the suction hole 12 by a suction pressure.

The blades 14 may be formed to be perpendicular to the floor to be cleaned, and to be inclined in the diagonal direction. When the blades 14 are formed to be inclined in the diagonal direction, the impurities shaken off from the carpet hairs by the translation of the blades 14 are easily introduced into the vacuum channel 11. The blades 14 can be inclined in one direction, or the opposite directions around the center. That is, the blades 14 can be inclined in four types, namely, in the right direction (/), the left direction (\), the right direction at the left side and the left direction at the right side (/\), or the left direction at the left side and the right direction at the right side(\/).

Figure 8:
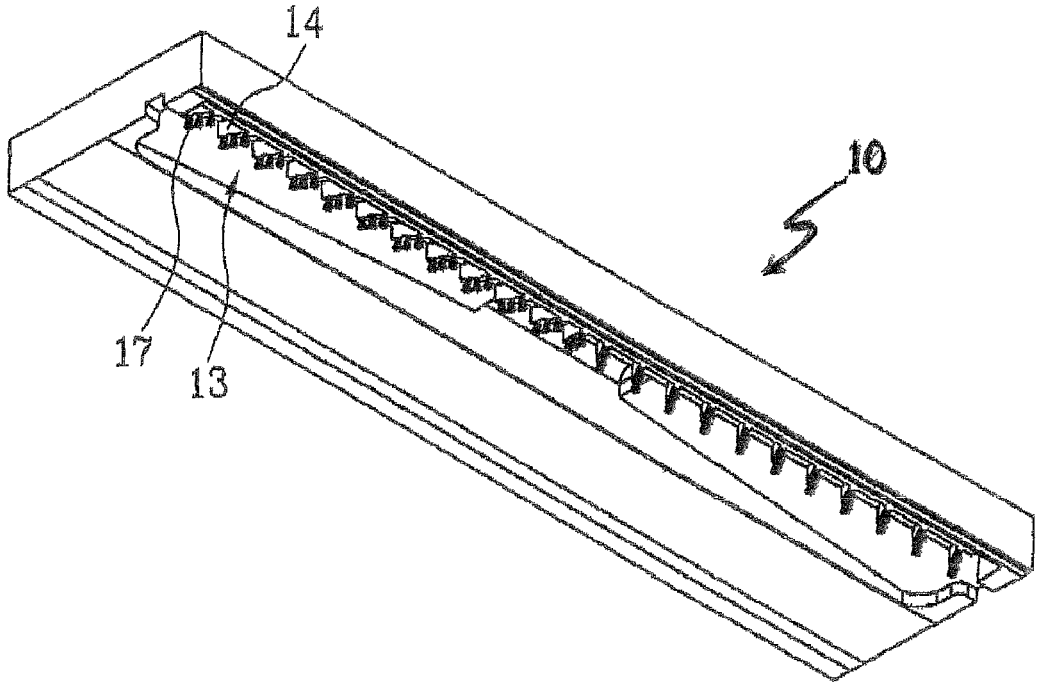

FIG. 8 illustrates the suction nozzle portion in which brushes are formed at the blades. In yet another aspect of the present invention, brushes 17 are installed at the bottom end of the agitator 13. Brush bristles smaller than the thickness of the blades 14 can be easily inserted between the carpet hairs than the blades 14. When the brushes 17 are agitated between the carpet hairs, the impurities between the carpet hairs are efficiently shaken off.

Figure 9:
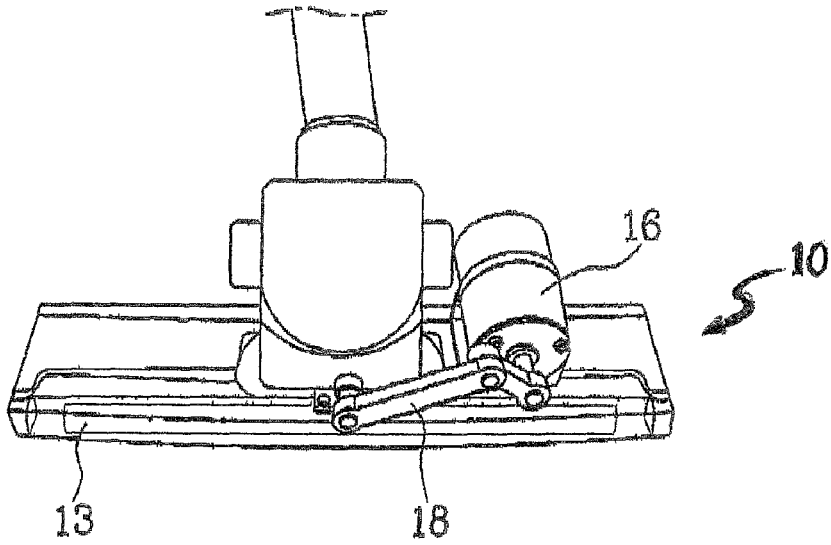
FIGS. 9 to 11 illustrate an agitator supplied with a dynamic force of a driving unit by a slider-crank in accordance with the present invention.
Figure 10:
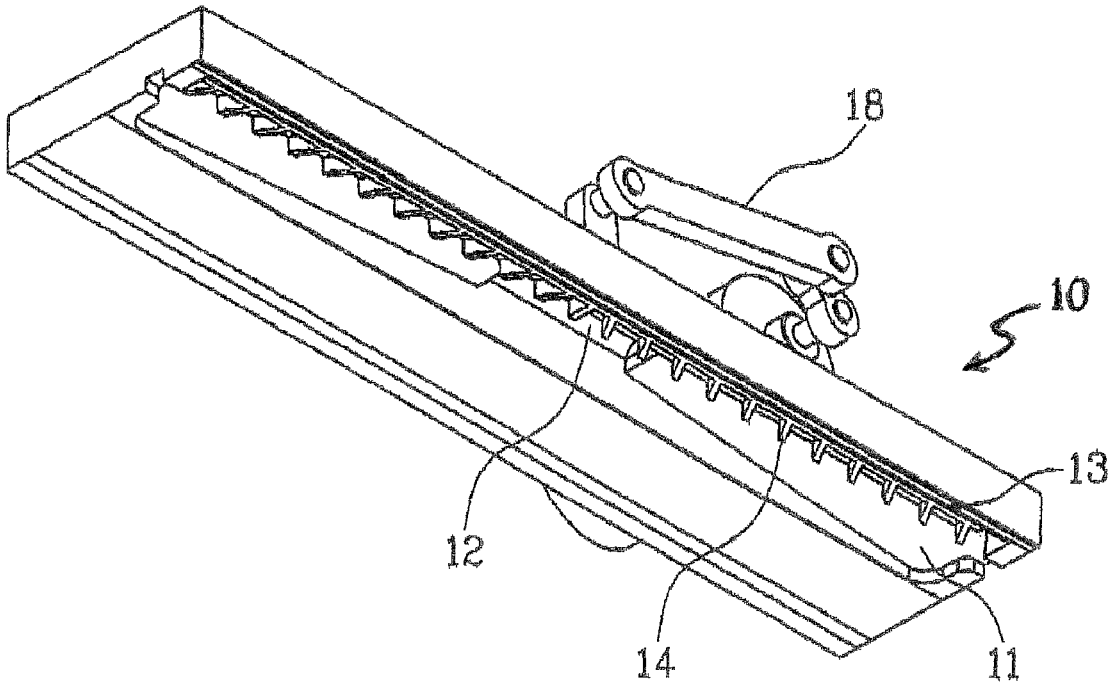
Figure 11:
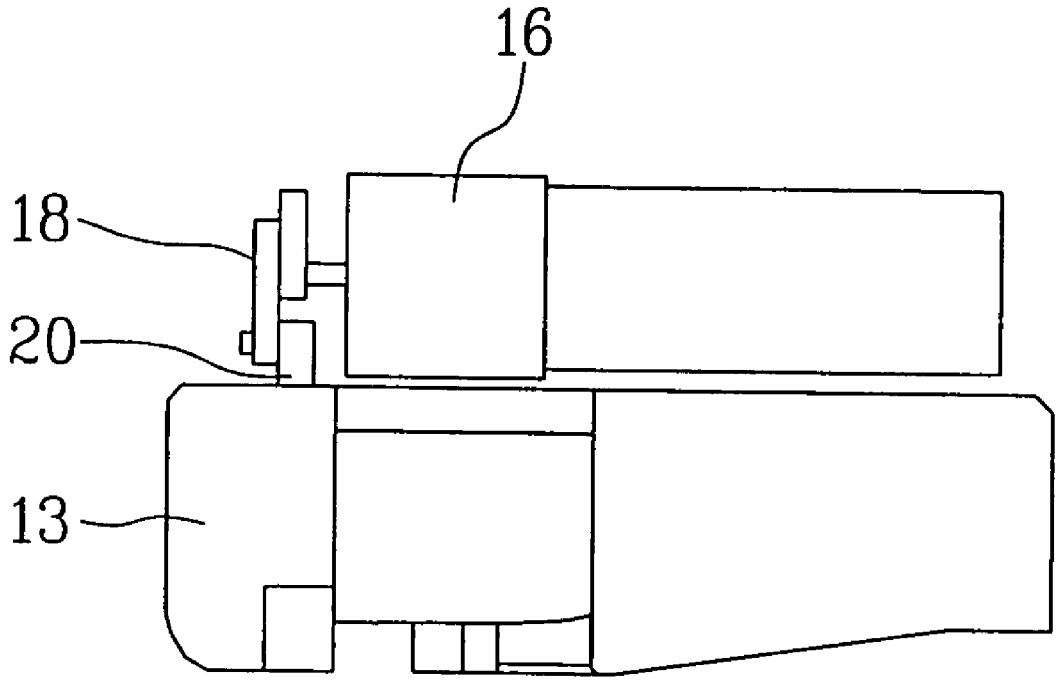

FIGS. 9 to 11 illustrate a vacuum cleaner in which a driving unit includes a motor and a slider-crank in accordance with the present invention. A driving unit 16 transfers a dynamic force to an agitator 13 through a slider-crank 18. The slider-crank 18 converts the rotation of the driving unit 16 into the linear motion, and transfers the linear motion to a driven portion 20 of the agitator 13 so that the agitator 13 can perform the linear translation. As compared with the conventional transmission belt for transferring the dynamic force, the slider-crank 18 has a long lifespan and stably transfers the dynamic force.

Figure 12:
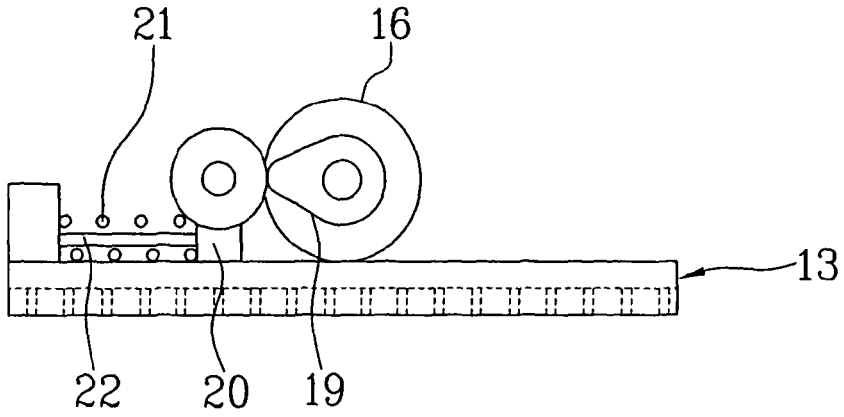
FIG. 12 illustrates an agitator supplied with a dynamic force of a driving unit by a tangent cam in accordance with the present invention.

FIG. 12 illustrates a vacuum cleaner in which a driving unit includes a motor, a tangent cam and a spring in accordance with the present invention. A driving unit 16 transfers a dynamic force to a driven portion 20 of an agitator 13 connected to a spring 21 through a tangent cam 19. Both ends of the spring 21 are connected to a suction nozzle portion and the driven portion 20 of the agitator 13, respectively. The tangent cam 19 and the spring 21 convert the rotation of the driving unit 16 into the linear motion so that the agitator 13 can perform the linear translation.

Figure 13:
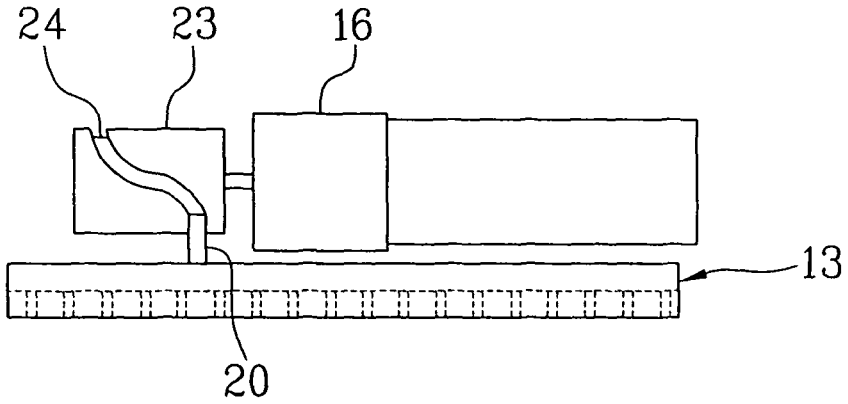
FIG. 13 illustrates an agitator supplied with a dynamic force of a driving unit by a cylindrical cam in accordance with the present invention.

FIG. 13 illustrates a vacuum cleaner in accordance with yet another embodiment of the present invention. A driving unit 16 transfers a dynamic force to a driven portion 20 of an agitator 13 by a cylindrical cam 23. As the driven portion 20 of the agitator 13 moves along a groove 24 of the cylindrical cam 23, the rotation of the driving unit 16 is converted into the linear motion.

The vacuum cleaner including the suction nozzle portion having the agitator performing the linear translation shows more excellent cleaning performance on the carpet than another vacuum cleaner operated with the same suction pressure, namely, the vacuum cleaner including the ordinary type nozzle portion or the rotary brush. In order to verify the improvement of the cleaning performance, the graph of FIG. 14 shows the cleaning performance experiment result of the vacuum cleaner in accordance with the present invention.

Figure 14:
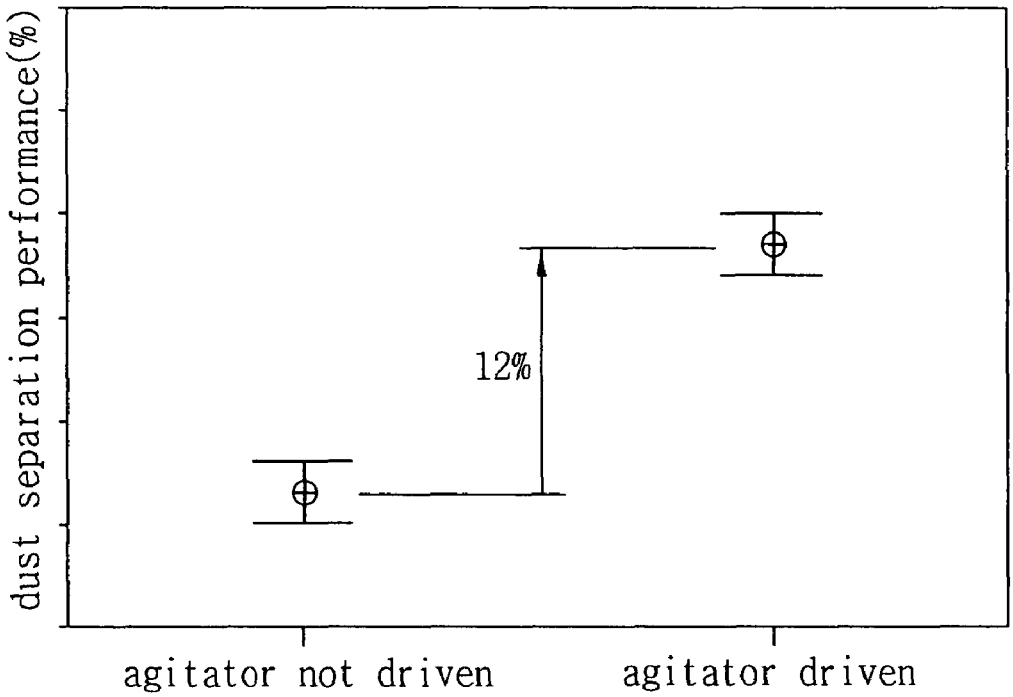
FIG. 14 is a graph showing the cleaning performance when the agitator is driven and when the agitator is not driven in the vacuum cleaner having the agitator in accordance with the present invention.

FIG. 14 shows the cleaning performance when the agitator 13 is driven and when the agitator 13 is not driven in the vacuum cleaner including the suction nozzle portion in which the agitator 13 is installed in accordance with the present invention. Here, the cleaning performance is referred to as dust separation performance, which is represented by:

$$\text{Sucked dust}/\text{Coated dust} \times 100(\%)$$

According to the experiment, when the agitator 13 is driven, the dust separation performance increases by 12%.

Although the preferred embodiments of the present invention have been described, it is understood that the present invention should not be limited to these preferred embodiments but various changes and modifications can be made by one skilled in the art within the spirit and scope of the present invention as hereinafter claimed.

INDUSTRIAL APPLICABILITY

In accordance with the present invention, the vacuum cleaner including the suction nozzle portion having the agitator overcomes difficulty in sucking the impurities from the carpet due to adhesion between the impurities and the carpet hairs. The vacuum cleaner includes the agitator for lifting the impurities, and maintains the surface pressure like the ordinary type suction nozzle portion, thereby more efficiently cleaning the carpet than the conventional vacuum cleaner.

In addition, the crank shaft and the cam transfer the dynamic force to the agitator. As compared with the transmission belt for transferring the dynamic force to the agitator, the crank shaft and the cam can improve the lifespan and reliability of the product.

What is claimed is:

1. A vacuum cleaner, comprising:

a vacuum cleaner main body that generates a suction force;

a suction nozzle portion that sucks impurities by the suction force;

a suction passage that connects the suction nozzle portion to a suction pump;

a vacuum channel provided at a bottom surface of the suction nozzle portion and connected to the suction passage;

an agitator installed in at least one of a front direction and a backward direction of the vacuum channel as well as outside the vacuum channel that performs a linear translation; and a driving device installed separately from the suction passage that drives the agitator, wherein the agitator comprises a plurality of protruding blades.

2. The vacuum cleaner of claim 1, wherein a length of the agitator is smaller than a length of the suction nozzle portion and a length of an agitator guide.

3. The vacuum cleaner of claim 1, wherein an agitator guide comprises a groove that receives the agitator.

4. The vacuum cleaner of claim 1, wherein each of the plurality of blades comprises a brush provided at a protruding end thereof.

5. The vacuum cleaner of claim 1, wherein the plurality of blades are diagonally inclined to a translation direction of the agitator.

6. A vacuum cleaner, comprising:

a vacuum cleaner main body that generates a suction force;

a suction nozzle portion that sucks impurities by the suction force;

a suction passage that connects the suction nozzle portion to a suction pump;

a vacuum channel provided at a bottom surface of the suction nozzle portion and connected to the suction passage;

an agitator installed in at least one of a front direction and a backward direction of the vacuum channel as well as outside the vacuum channel that performs a linear translation; and a driving device installed separately from the suction passage that drives the agitator, wherein the driving device further comprises a slider-crank and a motor, so that a rotation of the motor is converted into the translation that is transferred to the agitator by the slider-crank.

7. A vacuum cleaner, comprising:

a vacuum cleaner main body that generates a suction force;

a suction nozzle portion that sucks impurities by the suction force;

a suction passage that connects the suction nozzle portion to a suction pump;

a vacuum channel provided at a bottom surface of the suction nozzle portion and connected to the suction passage;

an agitator installed in at least one of a front direction and a backward direction of the vacuum channel as well as outside the vacuum channel that performs a linear translation; and a driving device installed separately from the suction passage that drives the agitator, wherein the driving device further comprises a tangent cam, a motor, and a spring installed between the agitator and the suction nozzle portion, so that a rotation of the motor is converted into a linear motion that is transferred to the agitator by the tangent cam and the spring.

8. A vacuum cleaner, comprising:

a vacuum cleaner main body that generates a suction force;

a suction nozzle portion that sucks impurities by the suction force;

a suction passage that connects the suction nozzle portion to a suction pump;

a vacuum channel provided at a bottom surface of the suction nozzle portion and connected to the suction passage;

an agitator installed in at least one of a front direction and a backward direction of the vacuum channel as well as outside the vacuum channel that performs a linear translation; and a driving device installed separately from the suction passage that drives the agitator, wherein the driving device further comprises a cylindrical cam, a driven portion, and a motor, so that a rotation of the motor is converted into a linear motion that is transferred to the agitator by the cylindrical cam and the driven portion.

9. The vacuum cleaner of claim 8, wherein the driven portion moves along a groove provided on the cylindrical cam.

10. A vacuum cleaner, comprising:

a vacuum cleaner main body that generates a suction force;

a suction nozzle portion that sucks impurities by the suction force;

a suction passage that connects the suction nozzle portion to a suction pump;

a vacuum channel provided at a bottom surface of the suction nozzle portion and connected to the suction passage;

an agitator installed in at least one of a front direction and a backward direction of the vacuum channel as well as outside the vacuum channel that performs a linear translation; and a driving device installed separately from the suction passage that drives the agitator, wherein the suction nozzle portion comprises an agitator guide at the bottom surface thereof.

11. The vacuum cleaner of claim 10, wherein the agitator guide and the agitator further comprise a rail member.

12. The vacuum cleaner of claim 11, wherein the rail member comprises a rail and a rail groove.

* * * * *